United States Patent [19]

Losenno

[11] 3,966,245

[45] June 29, 1976

[54] MULTIOPERATIONAL LATCH

[76] Inventor: Luigi G. Losenno, 3804 Thomas Ave. S., Minneapolis, Minn. 55410

[22] Filed: Jan. 30, 1975

[21] Appl. No.: 545,506

[52] U.S. Cl. ..... 292/202; 292/DIG. 15

[51] Int. Cl.[2] ..... E05C 17/14

[58] Field of Search ..... 292/202, 262, 19, 78, 292/218, 228, 338, DIG. 5

[56] References Cited

UNITED STATES PATENTS

| | | | |
|---|---|---|---|
| 217,762 | 7/1879 | Witte | 292/338 |
| 2,704,220 | 3/1955 | Graham | 292/DIG. 15 |

*Primary Examiner*—R. E. Moore

*Attorney, Agent, or Firm*—Wicks & Nemer

[57] ABSTRACT

A multioperational latch is disclosed, in the preferred form, as including a member pivotally mounting a latch member to the inside surface of a door and a member mounted in a stationary position with respect to the door frame which receives and removably captures an enlarged end of the latch member. Therefore, the latch can be placed in a first, privacy position to prevent the door from being moved from its closed position, in a second, latch position where the enlarged end of the latch member is captured within the receiving member to hold the door in its open position, and in a third, inoperative position allowing the door to be freely moved either to or from its open or closed position.

10 Claims, 3 Drawing Figures

MULTIOPERATIONAL LATCH

BACKGROUND

This invention relates generally to a latch and more specifically to a multioperational latch.

In the field of doorstops and privacy guarding devices, various types of apparatus are available. However, each type of apparatus currently known to be available perform a single function. Therefore, they present serious limitations and deficiencies in that several of such apparatus are required to perform various functions to be desired.

Therefore, there is a definite need in the art for a latch which performs several functions. Further, the latch should be of simple design, easy to use, and maximize the materials used.

Therefore, it is a primary object of this invention to provide such a novel latch.

It is also an object of this invention to provide such a novel multioperational latch.

It is also an object of this invention to provide such a multioperational latch which maximizes the materials used.

It is also an object of this invention to provide such a novel multioperational latch which can be used to hold the door in an open, latch position or used to hold the door in a closed, privacy position or placed in an inoperative position.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DESCRIPTION

Figure 1:
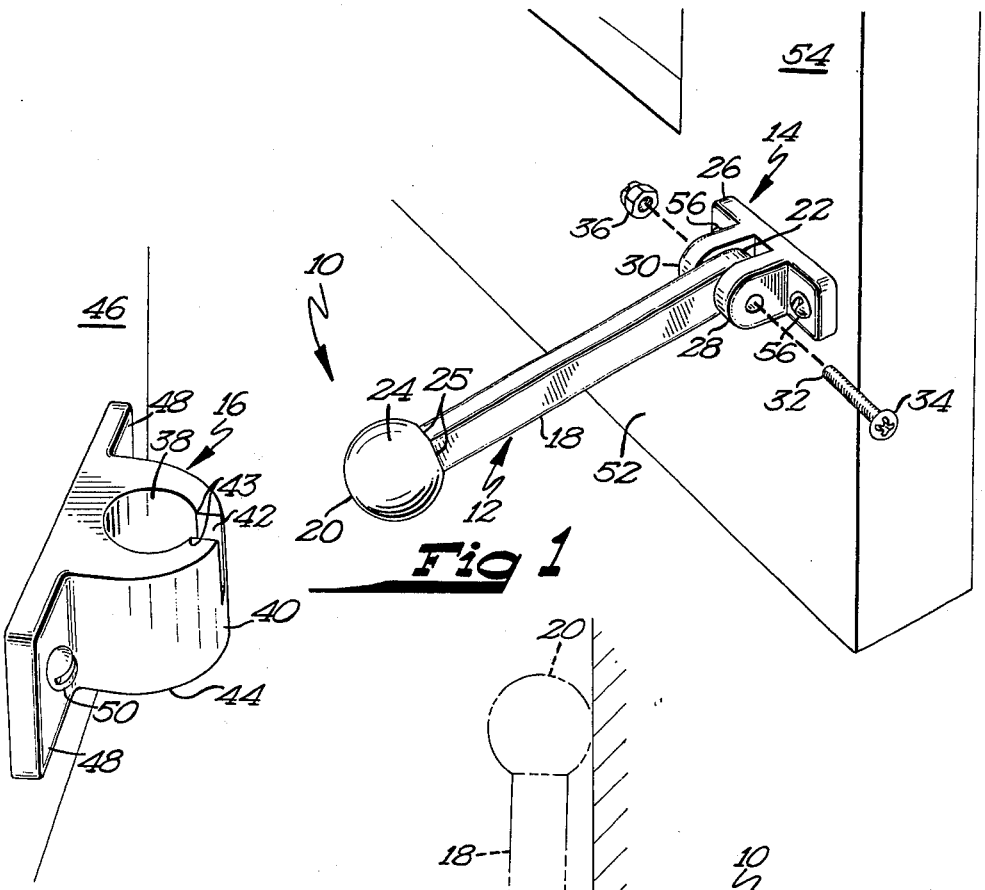
FIG. 1 shows a perspective view of a multioperation latch according to the teachings of the present invention.

In the figures, a multioperational latch according to the teachings of the present invention is shown and generally designated 10. Latch 10 includes a latch member 12, a pivot member 14, and a receiving and removably capturing member 16. Latch member 12 includes an elongated bar 18, shown in its preferred form as having a rectangular cross section, having a first end 20 and a second end 22. First end 20 includes an enlargement 24 in the form of a foot on first end 20 of latch member 12 forming shoulders 25 thereon. In the preferred embodiment, the shape of foot 24 is spherical in nature and has a substantially circular latitudinal cross section. Second end 22 of latch member 12 is pivotally mounted by pivot member 14.

In the preferred embodiment, pivot member 14 includes a support member 26, a first pivot arm 28, and a second pivot arm 30. First and second pivot arms 28 and 30 are outstanding from and attached at their inner ends to support member 26. First pivot arm 28 is laterally spaced a distance greater than the width of latch member 12 from and parallel to second pivot arm 30. Second end 22 of latch member 12 is then located between first and second pivot arm 28 and 30, respectively. A pivot member 32 shown in its preferred form as a bolt, extends through a transverse hole formed in first pivot arm 28, the second end 22 of latch member 12, and second pivot arm 30. Pivot member 32 includes a head 34 and a nut 36.

Figure 2:
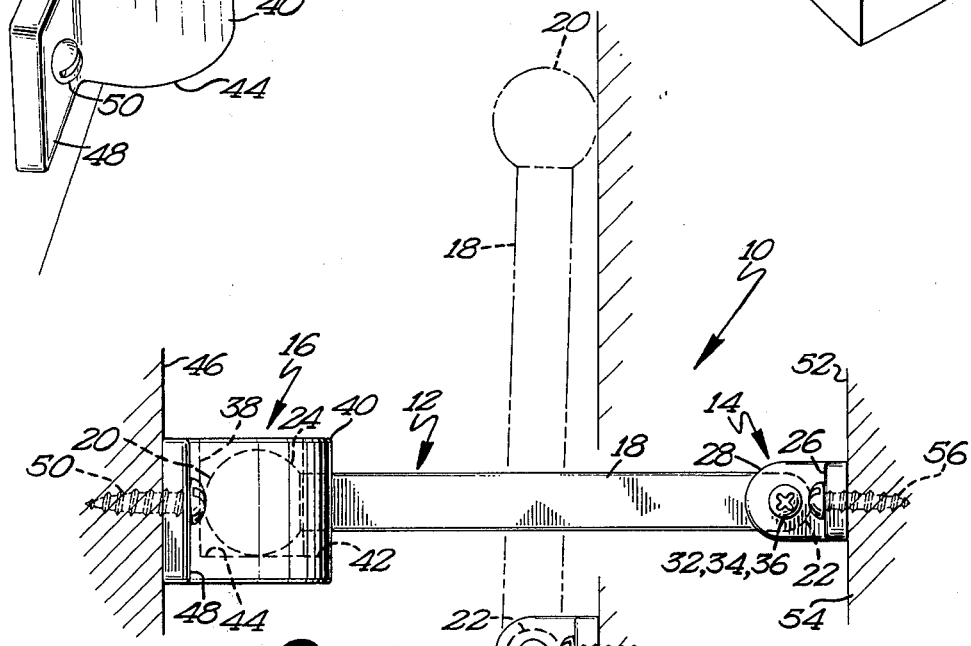
FIG. 2 shows a side view of the multioperation latch of FIG. 1 in its latch position.

Therefore, latch member 12 can be pivoted to a first privacy position as shown in solid line in FIG. 3, to a second latch position as shown in FIG. 2, and to a third inoperative position as shown in phantom in FIG. 3 and will be explained further hereinafter.

Receiving and removably capturing member 16 includes a cavity 38 formed by side walls 40. Cavity 38 is preferably cylindrical in shape and has a cross section of a size substantially equal to the latitudinal cross section of foot 24. Further included in receiving and removably capturing member 16 is a slot 42 formed in side walls 40 in the front of member 16, which intersects with cavity 38 thus forming shoulders 43 therein. The width of slot 42 should be substantially equal to the width of bar 18 of latch member 12, to allow slot 42 to removably receive bar 18 of latch member 12 therein, as best seen in FIG. 2. A cavity bottom 44 can further be provided to prevent foot 24 from falling through and out of cavity 38 under the action of gravity, when the latch is in its preferred orientation. Receiving and removably capturing member 16 is mounted in a stationary position with respect to the door frame, not specifically shown, for example on a wall 46 which extends perpendicularly to the door frame. A mounting bracket 48 is attached to side walls 40 of cavity 38. Suitable screws 50 extend through bracket 48 and into wall 46 for securedly mounting receiving and removably capturing member 16 to wall 46.

Pivot member 14 can be attached to the inside surface 52 of door 54 by suitable screws 56 which extend through support member 26 into door 54. Pivot member 14 should preferably be located above the top surface 58 of floor 60 a distance sufficient to allow the angle between vertical inside surface 52 of door 54 and the longitudinal axis of latch member 12 to be less than 45° when latch member 12 is pivoted to its first, privacy position shown in solid lines in FIG. 3, as will be explained further hereinafter.

OPERATION

Latch 10 of the present invention performs several functions. First, it performs as a privacy guard where latch 10 can be used to prevent a door from being moved from its closed position. Thus, latch 10 can prevent the door from being opened, even if the person desiring to enter has a key for the door lock. For example, latch 10 can prevent a maid from entering a hotel for cleaning, if the occupant still remains in the room and does not wish to be disturbed.

Secondly, it performs as a latch member to hold the door open. For example, a door which is biased to its closed position can be latched in its open position by the use of latch 10 of the present invention.

Thirdly, latch 10 can be placed in a nonoperative position allowing the door to be freely moved from either its closed or open position.

Further, latch 10 can be used to perform other functions as will now be obvious to those skilled in the art in view of the present invention.

Figure 3:
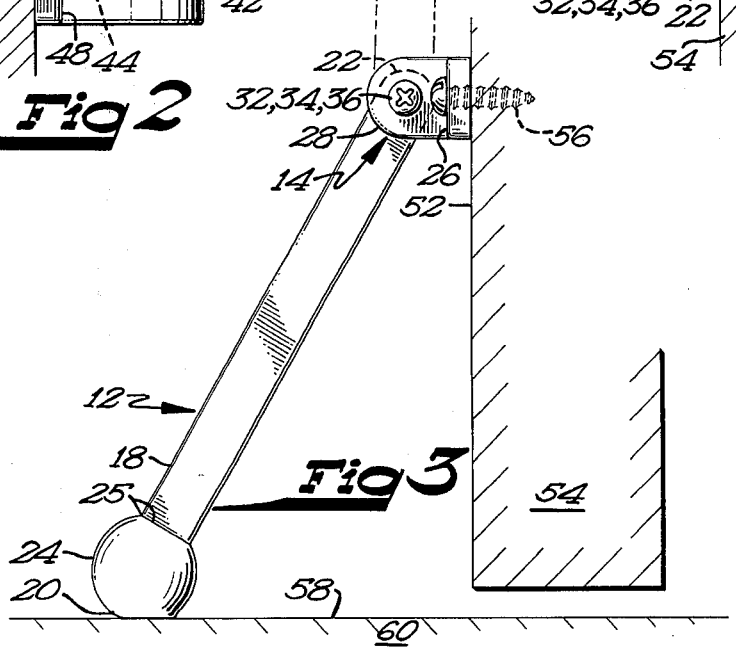
FIG. 3 shows the multioperation latch of FIG. 1 in its privacy position, in solid lines, and in its nonoperative position, in phantom.

When it is desired to prevent the door 54 from moving from its closed position, latch member 12 of latch 10 can be pivoted within pivot member 14 and placed in a first downward, privacy position, as best seen in solid line in FIG. 3. In such a position, if a person should attempt to open door 54, foot 24 of latch member 12 will not slide on top surface 58 of floor 60. Therefore, latch member 12 acts as a brace between floor 60 and door 54, and door 54 is prevented from moving from its closed position. If a person wishes to insure that his privacy will not be interrupted, he pivots latch member 12 to its first downward, privacy position as shown in FIG. 3 and therefore will prevent anyone from opening door 54.

It has been found, for best results, that the angle between latch member 12 and inside surface 52 of door 54 should be less than 45° when latch 10 is in its first, privacy position as best seen in solid line in FIG. 3. When the angle is equal to 45°, the force directed downward by foot 24 on floor 60 is equal to the sliding force applied to floor 60 by foot 24 due to the force on door 54 while attempting to open it. If the angle is larger than 45°, the downward force would be less than the sliding force and therefore foot 24 would have a larger tendency to slide on top surface 58 of floor 60. However, if the angle is less than 45°, the downward force would be greater than the sliding force, and therefore foot 24 would not have the tendency to slide on top surface 58 of door 60. Therefore, for best results pivot member 14 should be attached to the door 54 allowing the angle between the longitudinal axis of latch member 12 and the vertical inside surface 52 of door 54 to be less than 45° in the first downward, privacy position, as shown in solid line in FIG. 3.

When it is desired to hold door 54 in its open position, latch 10 can also be arranged to perform this function. Latch member 12 is pivoted slightly above its second, horizontal latch position, as shown in FIG. 2. Door 54 is then opened until foot 24 can be placed directly over cavity 38. At this time, latch member 12 can be positioned such that foot 24 is placed within cavity 38 and bar 18 can be positioned within slot 42 as best seen in FIG. 2. Foot 24 is received within and removably captured within cavity 38 of member 16. Since the latitudinal cross section of foot 24 is substantially equal to the cross section of cavity 38, latch member 12 will be firmly held by receiving and removably capturing member 16. It should be noted that shoulders 25 of latch member 12 abut with shoulders 43 of member 16 to firmly hold and prevent movement of latch member 12 within or out of member 16. Therefore, door 54 will be held in its open position. Cavity bottom 44 prevents foot 24 from falling through and out of cavity 38 under the action of gravity when latch member 12 is in its second position.

Receiving and removably capturing member 16 should be attached to wall 46 by screws 50 which pass through mounting bracket 48 at a height such that when foot 24 of latch member 12 is positioned within cavity 38, latch member 12 should be in a substantially horizontal position, as best seen in FIG. 2. This will aid in preventing foot 24 from jumping out of cavity 38 if a force is accidentally placed on door 54.

Latch 10 can also be placed in an inoperative position. In its inoperative position, latch 10 will allow the door to swing freely from either its open or closed position. In its inoperative position, latch member 12 is placed in an upraised, nonoperative position as shown in phantom in FIG. 3. In such a position, foot 24 of latch member 12 will rest on inside surface 52 of door 54. Therefore, foot 24 will not engage the top surface 58 of floor 60 and will not engage receiving and removably capturing member 16.

If it is desired to open door 54 when latch 10 is in its privacy position, latch member 12 can be pivoted within pivot member 14 from its first, downward, privacy position as shown in solid in FIG. 3 to its third upraised, nonoperative position as shown in phantom in FIG. 3. In a similar manner, when it is desired to close door 54 when latch 10 is in its latch position, latch member 12 can be raised from its second horizontal, latch position as shown in FIG. 2 to its third upraised, nonoperative position as shown in phantom in FIG. 3 removing foot 24 from cavity 38. Therefore, door 54 is free to move from its open position.

It should be noted that pivot arms 28 and 30 should be of a sufficient length to allow latch member 12 to pass beyond its vertical position as shown in phantom in FIG. 3. In such a position, latch member 12 will have a lesser tendency to pivot in pivot member 14 from its nonoperative position. For example, if door 54 was slammed to its closed position and latch member was not beyond its vertical position, latch member 12 could fall from its inoperative position. Therefore, to insure that latch member 12 does not pivot within pivot member 14, latch member 12 should be positioned beyond its vertical position, as shown in phantom in FIG. 3.

Now that the basic teachings of the present invention have been explained, many extensions and variations will be obvious to one having ordinary skill in the art. For example, foot 24 and cavity 38 could have other various shapes, cross sections, and/or sizes.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than the foregoing description, and all changes which come within the meaning and range of equivalency of the claims are intended to be embraced therein.

What is claimed is:

1. Multioperational latch for use with a door, having an inside surface, where the door can be placed in open and closed positions with respect to a door frame comprising in combination: an elongated latch member having a first end and a second end; the first end including a foot;

means for pivotally mounting the second end of the latch member to a first downward, privacy position, a second horizontal latch position, and a third upraised, nonoperative position; means for mounting the pivot means to the inside surface of the door; means for removably capturing and receiving the foot of the latch member; and means for mounting the receiving means in a stationary position with respect to the door frame, with the first privacy position of the latch member preventing the door from being moved from its closed position, the second position being where the foot of the latch member is captured within the receiving means holding the door in its open position, and the third position allowing the door to be freely moved either to or from its open or closed position.

2. The latch of claim 1 wherein the foot of the latch member comprises an enlargement of the latch member, wherein the capturing and receiving means comprises sidewalls defining a cavity, with the sidewalls including a slot intersecting with the cavity, and wherein the latch member is received within the slot and the foot is received within the cavity defined by the sidewalls.

3. The latch of claim 2 wherein the foot comprises an enlargement of the latch member whose latitudinal cross section is substantially equal to the cross section of the cavity.

4. The latch of claim 3 wherein the foot of the latch member as shoulders formed thereon and wherein the removably capturing and receiving means includes shoulders such that when the latch member is in the second position the shoulders of the foot of the latch member abut with the shoulders of the removably capturing and receiving means to firmly hold and prevent movement of the latch member with respect to removably capturing and receiving means.

5. The latch of claim 4 wherein the pivot means comprises, in combination: a support member; a first pivot arm and a second pivot arm attached to and extending from the support member, with the first pivot arm being spaced from and parallel to the second pivot arm with the latch member located therebetween; and a pivot member which extends through the first and second pivot arms and the second end of the latch member.

6. The latch of claim 5 wherein pivot means mounting means comprises screws which pass through the support member and are intended to pass into the door.

7. The latch of claim 5 wherein in the first position, the angle of latch member with respect to the inside surface of the door is adapted to be less than 45°.

8. The latch of claim 1 wherein the foot of the latch member has shoulders formed thereon and wherein the removably capturing and receiving means includes shoulders such that when the latch member is in the second position the shoulders of the foot of the latch member abut with the shoulders of the removably capturing and receiving means to firmly hold and prevent movement of the latch member with respect to removably capturing and receiving means.

9. The latch of claim 2 wherein in the first position, the angle of latch member with respect to the inside surface of the door is adapted to be less than 45°.

10. The latch of claim 1 wherein in the first position, the angle of latch member with respect to the inside surface of the door is adapted to be less than 45°.

* * * * *